US006889912B2

(12) United States Patent
Clum et al.

(10) Patent No.: US 6,889,912 B2
(45) Date of Patent: May 10, 2005

(54) METHOD AND APPARATUS FOR REMOVING TRAPPED WATER

(75) Inventors: Gerald M. Clum, Waverly, PA (US); Eric M. Clum, Olyphant, PA (US)

(73) Assignee: GECCO LLC, Wilmington, DE (US)

( * ) Notice: Subject to any disclaimer, the term of this patent is extended or adjusted under 35 U.S.C. 154(b) by 478 days.

(21) Appl. No.: 10/040,094

(22) Filed: Jan. 4, 2002

(65) Prior Publication Data

US 2003/0080196 A1 May 1, 2003

Related U.S. Application Data

(60) Provisional application No. 60/336,230, filed on Oct. 29, 2001.

(51) Int. Cl.[7] ..... B05B 17/00; A62C 35/00; A62C 37/30

(52) U.S. Cl. ..... 239/1; 169/43; 169/5; 169/37; 169/19; 169/20

(58) Field of Search ..... 239/1, 124, 126, 239/127, 93, 95, 569, DIG. 15; 169/43, 5, 37, 19, 20; 137/559; 251/206, 207, 208, 209

(56) References Cited

U.S. PATENT DOCUMENTS 3,602,938 A * 9/1971 Lindsay ..... 15/314
3,896,992 A * 7/1975 Borovina et al. ..... 237/19
4,128,128 A 12/1978 Mears
4,286,668 A 9/1981 McCormick
4,655,078 A 4/1987 Johnson
4,704,983 A 11/1987 Rung
4,993,453 A 2/1991 McHugh
5,139,044 A 8/1992 Otten et al.
5,228,469 A 7/1993 Otten et al.
5,263,290 A 11/1993 Gardner
5,344,193 A 9/1994 Rio
5,692,571 A * 12/1997 Jackson ..... 169/16
5,725,009 A 3/1998 Mallow, Sr. et al.
5,752,540 A 5/1998 Hansel, Sr.
5,808,905 A 9/1998 Normann et al.
6,227,232 B1 5/2001 Williams, Sr.

FOREIGN PATENT DOCUMENTS

JP 2001037902 A * 7/1999 ..... A62C/27/00

* cited by examiner

*Primary Examiner*—Davis Hwu
(74) *Attorney, Agent, or Firm*—Pepper Hamilton LLP

(57) ABSTRACT

An apparatus and method for clean, efficient removal of water and odor from a sprinkler systems including a vessel, a pump which creates a reduced pressure in the vessel, and a connector for attaching the device to the sprinkler system to remove trapped water. The vacuum pump is powered by a power source, and the reduced pressure created by vacuum pump is controlled by a regulator such that the vacuum pressure is maintained and does not cause damage to the gaskets in the sprinkler system.

25 Claims, 4 Drawing Sheets

METHOD AND APPARATUS FOR REMOVING TRAPPED WATER

This application claims priority to U.S. application Ser. No. 60/336,230, filed Oct. 29, 2001, the complete disclosure of which is incorporated herein by reference.

FIELD OF THE INVENTION

The present invention relates generally to the field of fire safety systems. More specifically, the invention relates to a method and apparatus for the removal of water from piping systems which prevents contamination or leakage of water from sprinkler system pipes during repairs.

BACKGROUND OF THE INVENTION

Most commercial buildings, hotels, hospitals and nursing homes are required by law to include fire extinguishing sprinkler systems incorporated into the building's structure. These sprinkler systems are generally housed in the ceilings of buildings, or the ceilings of each floor in a building, and are comprised of pipes of varying diameters. The systems are typically fed directly from a city water main, and are designed to deliver large amounts of water to a fire upon activation by the heat emanating from the fire. The pipes of a typical sprinkler system run from the water main, through the walls or core of the building, and along the space above ceilings. Smaller pipes drop off from the pipes in the ceiling spaces. Such smaller pipes, or "drops" provide water to the sprinkler heads located in the ceilings of the rooms or areas serviced by the sprinkler system. A sprinkler head is typically located at the end of each pipe "drop." Water is contained in the pipes at almost all times, as needed in case of a fire.

Generally, when a sprinkler system needs to be repaired the entire system of pipes must be drained of the water, especially when the sprinkler heads must be removed and replaced. Drainage of the system generally occurs at a main drain, often called a gang drain, that is typically located outside the building, or outside each floor of the building. Draining the system entails opening the main drain valve, and waiting until the water stops flowing out of the main drain.

However, this method does not drain the entire system. Stagnant trapped water, often called "black water," remains in the "drops" at each sprinkler head. Black water is malodorous, dirty and appears to contain bacteria rendering it particularly unsafe in clean or sterile environments, such as hospitals, nursing homes and laboratories. The existence of the black water in the sprinkler drops makes the removal of each sprinkler head, as needed for repairs and replacements, a messy, time-consuming process.

To remove a sprinkler head, the person removing the sprinkler head must carry a container up a ladder, and hold the container beneath the drop while the sprinkler head is removed. As the head is removed, the black water drains from the drop. Too often, the black water spills or splashes out of the container onto the surrounding walls and/or the floor below.

One potential problem with using a vacuum system to establish a pressure differential within the pipes of a sprinkler system in order to remove the black water would be to dislodge the gaskets in the system pipes. Gaskets are used in sprinkler system pipelines to seal the joints where two ends of pipes come together. The gaskets are held in place by a metal casing or coupling, internal pressure provides the final seal to hold the gaskets in place. However, if the vacuum pressure is too high inside the pipes, the gaskets may be drawn out of the couplings and out of the pipes, thus causing breaches in the pipelines where the pipes are joined.

As a result, there is a need in the art for a clean, efficient method to repair sprinkler systems and remove sprinkler heads without damaging the gaskets at the pipe joints.

SUMMARY

The present invention provides a method and apparatus to cleanly and efficiently repair sprinkler systems and remove sprinkler heads by creating a pressure differential within the system that is high enough to remove trapped water from the sprinkler drops, but does not damage the gaskets, or otherwise damaging the components of the system.

In one embodiment, the apparatus includes a vessel for containing water withdrawn from the sprinkler system, a connector for attaching the vessel to the sprinkler system, and a vacuum pump for creating a reduced pressure within the vessel, and, in turn, within the sprinkler system. Preferably the apparatus will also include a pressure regulator for maintaining an appropriate stable pressure differential within the vessel.

In one embodiment, the vessel is centrally positioned on skids, wheels or a trailer, and the connector is operably attached to a first end of the vessel, allowing for connection to sprinkler systems to remove water trapped in sprinkler system pipes. Also, the vacuum pump is driven by a power source that is attached to the apparatus, and is protected by a filter or trap that prevents water or solids within the water collected in the vessel from being drawn into the vacuum pump.

In one embodiment, the pressure regulator includes a pressure gauge and a pressure regulating valve that allows the individual operating the apparatus to monitor and control the reduced pressure within the vessel.

The method of removing water from pipes includes creating a stable reduced pressure within the system to remove water from the "drops" in the sprinkler system as the sprinkler heads are removed. In one embodiment, the method includes connecting the apparatus to the sprinkler system, actuating the apparatus to create the reduced pressure, and removing the sprinkler heads from the system, preferably one or more at a time. In one embodiment, the method also includes at least partially draining the system of water by opening a drain, such as the alarm drain or gang drain.

DETAILED DESCRIPTION OF THE INVENTION

Figure 1:
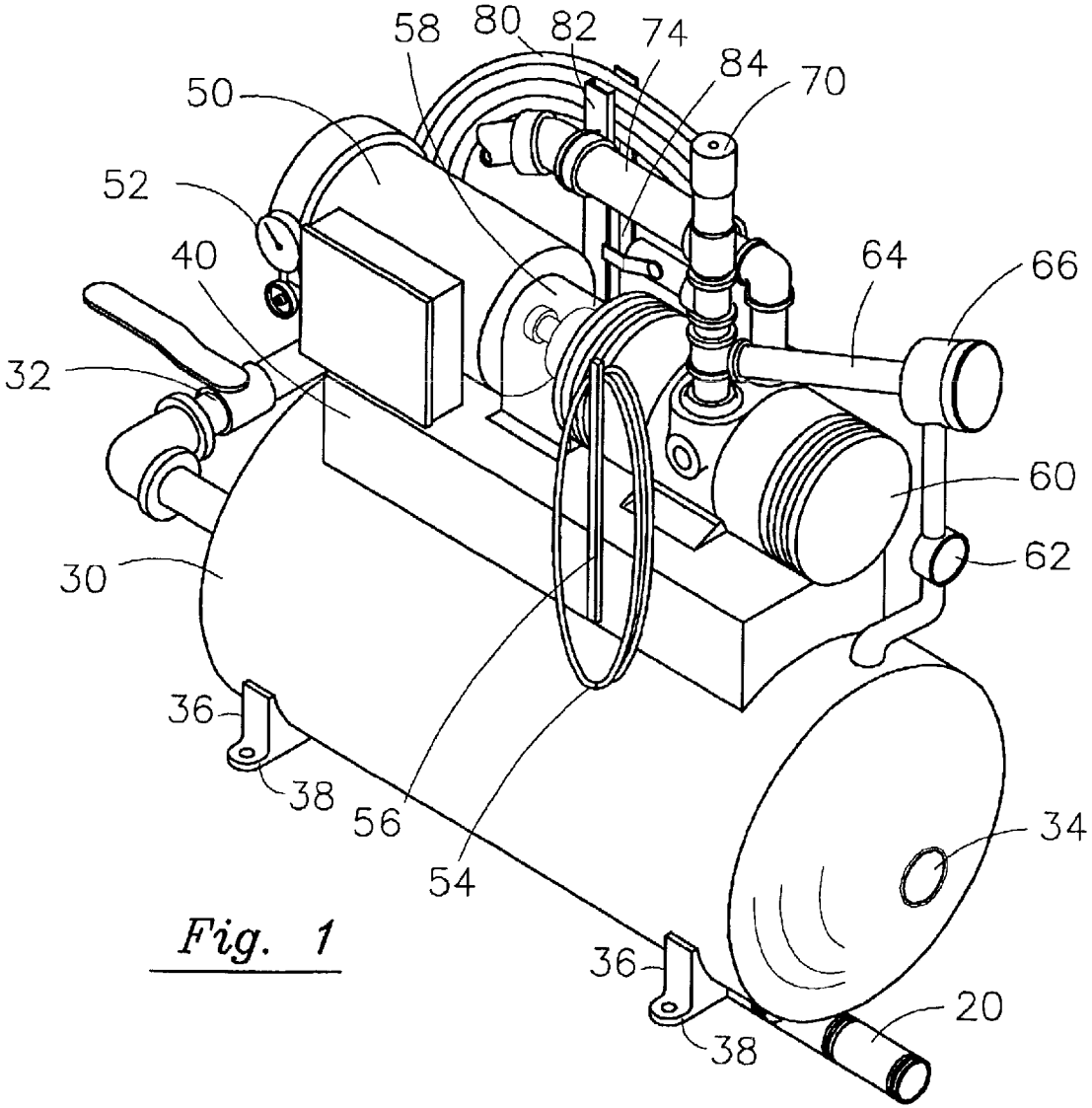
FIG. 1 is an isometric view of one side of the apparatus, showing the vessel, power source, vacuum pump, and pressure regulator.

Referring now to FIG. 1, an embodiment of the apparatus is shown from the side. The apparatus includes a vessel 30, upon which is mounted frame 40 which supports power source 50 and vacuum pump 60. Power source 50 is operably connected to and powers vacuum pump 60. The vessel 30 has a suction inlet with a ball valve 32 on one end, and a sight glass 34 on the opposite end. Drain valve 20 extends from the bottom of vessel 30 on one end. The vessel 30 is mounted on two supports 36 with apertures 38 for conveniently mounting to skids or wheels (not shown). Above one end of the vessel 30, and supported by frame 40 is power source 50. Power cord 54 extends from the side of power source 50 and is coiled on hook 56 which is located centrally on the apparatus above the vessel 30. Pressure gauge 52 is proximally located to power source 50. Adjacent to power source 50 on the other side, moving along the top of vessel 30, is stainless steel coupling guard 58. Stainless steel coupling guard 58 sits centrally above vessel 30, and in between power source 50 and vacuum pump 60. On the same side of vessel 30 as vacuum pump 60, is pipe 64, which connects vessel 30 to a filter 66. Pipe 64 then connects filter 66 to vacuum pump 60 on the top end of vacuum pump 60. Sight glass 62 is located on pipe 64. Attached to pipe 64 is pressure regulator 70, which extends vertically from the top of the vacuum pump 60 and pipe 64. Pressure regulator 70 is connected to muffler 74 above vacuum pump 60. Coiled behind muffler 74 is hose 80, stored on storage hook 82 which is connected to support channel 84.

Figure 2:
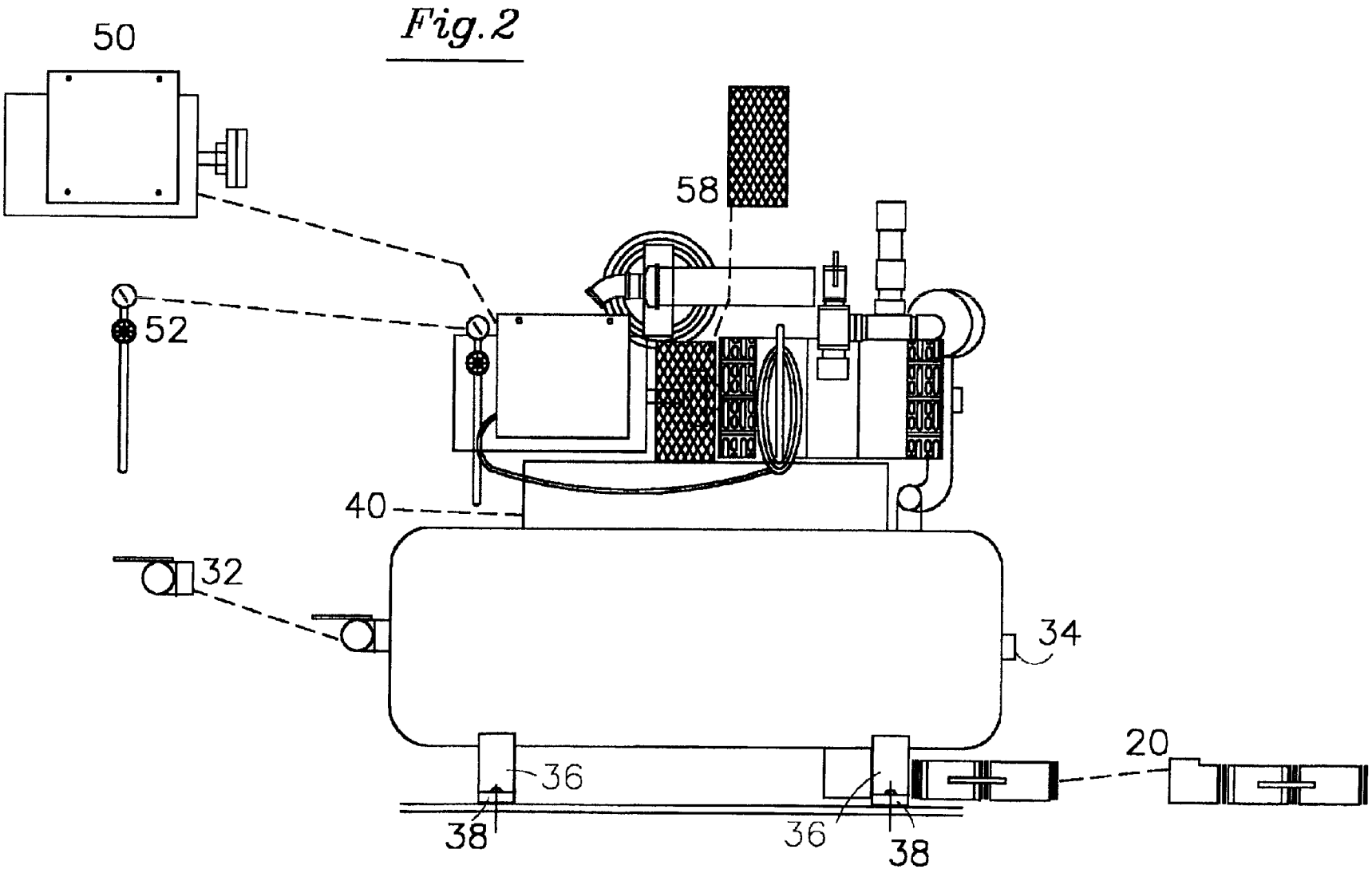
FIGS. 2 and 3 are parts views of one embodiment of the apparatus.
Figure 3:
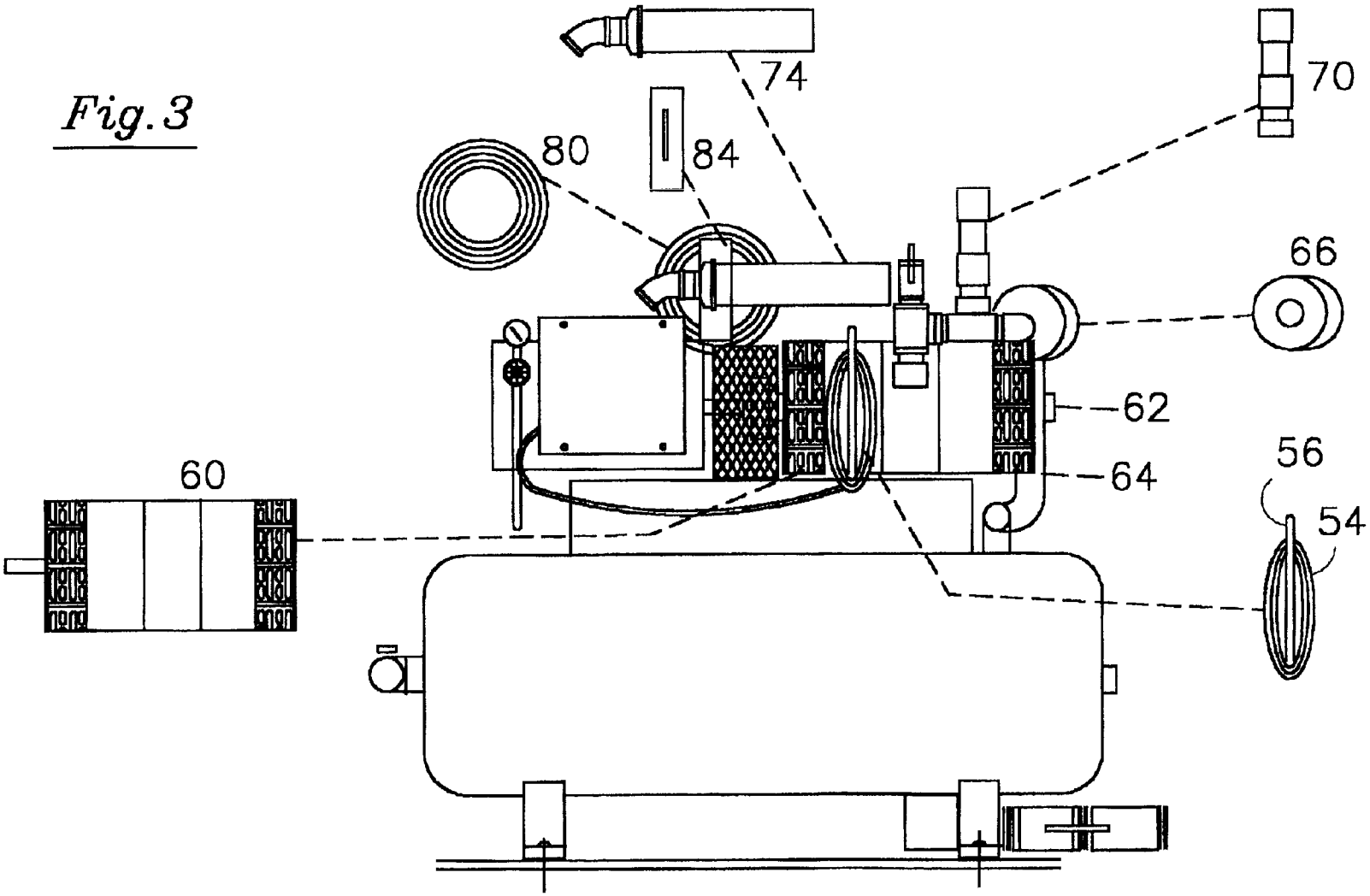

FIGS. 2 and 3 illustrate the individual parts of the preferred embodiment. Vessel 30 is preferably an ASME compliant tank, of variable size. Typically, vessel 30 has a 10 to 50 gallon capacity, and most preferably is of a size that does not make the apparatus difficult to move and transport. Vessel 30 is made of a material impervious to water, preferably metal. Although a tank is depicted as vessel 30 in FIGS. 2 and 3, it is recognized that any type of suitable container may be contemplated in this invention. In this embodiment, the drain valve 20 is 1 ½ inches in diameter and protrudes from the bottom of vessel 30, however it is recognized that other means for draining vessel 30 may be contemplated in this invention.

As depicted in FIGS. 1 and 3, vacuum pump 60 is preferably positioned on frame 40 directly above vessel 30 on one side of the apparatus. Vacuum pumps contemplated for use with the invention include piston, fan and screw type pumps, e.g. cylinder bounded devices for moving fluids such as air. For example, the disclosed embodiment uses a piston type vacuum pump operating at 1725 revolutions per minute, and capable of generating a reduced pressure/pressure differential of 0 to 29.9 inches of mercury. Here, vacuum pump 60 creates a stable reduced pressure of about 10 to 29.9 inches of mercury pressure. It is also recognized that any vacuum pump capable of generating a stable reduced pressure of about 10 to 29.9 inches of mercury pressure may be used and still fall within the scope of the invention.

Power source 50, illustrated in FIGS. 1 and 2, is an electric motor capable of generating about 3 horsepower. However, it is also recognized that any power source or engine capable of generating power sufficient to operate vacuum pump 60 may be used and still fall within the scope of the invention. For example, by using a larger motor with increased maximum horsepower, and one would increase the stability of the reduced pressure, and allow one to remove an increased number of sprinkler heads at once.

As indicated by FIG. 1, power source 50 provides power to vacuum pump 60. In this embodiment, power source 50 is positioned on frame 40, directly on top of vessel 30 on the opposite side of vessel 30 from the position of vacuum pump 60. Stainless steel coupling guard 58 covers the coupling that runs between power source 50 and vacuum pump 60. In the embodiment depicted, power source 50 has an external power source, e.g. an electric outlet, and power cord 54 is coiled for storage on hook 56, which is located on the side of the apparatus and attached to the apparatus between power source 50 and vacuum pump 60.

Returning to FIG. 1, a filter 66 is attached to pipe 64, which runs between vacuum pump 60 and vessel 30. A sight glass 62 may be positioned on pipe 64 to allow for monitoring the existence of water backing up into vacuum pump 60, and filter 66 prevents solids in the water in vessel 30 from entering vacuum pump 60 when the apparatus is being operated. Pressure regulator 70 is connected to vacuum pump 60, and also to muffler 74. In an alternative embodiment, muffler 74 may not be attached to the apparatus. Pressure gauge 52 is positioned, in the present embodiment as illustrated in FIGS. 1 and 2, along side power source 50.

As seen in FIGS. 1 and 3, situated behind the muffler, hose 80 is coiled for storage on hook 82, which is attached to support channel 84. Although a hose 80 is depicted in FIGS. 1 and 3, it is recognized that any flexible or bendable pipe, hose, or other suitable device may be used to attach the apparatus to a sprinkler system. Hose 80 is preferably 5 to 50 feet long. More preferably, hose 80 is 25 to 50 feet long, and is either integrally connected to the vessel 30 at one end, or is attached to the vessel 30 via a fitting, e.g. half of a male to female pipe fitting or friction fitting. Also, the end of the hose 80 which may be attached to the sprinkler system drain preferably ends with a fitting, e.g. a pipe fitting complementary to that found on the gang drain of the sprinkler system, or a friction fitting. However, it is recognized that any length hose or suitable device may be used in the apparatus so long as its material is water and vacuum resistant, and is of sufficient length to connect the apparatus to the system.

It is also recognized that components of the apparatus may be positioned differently, but still fall within the scope of the invention. For example, pressure gauge 52 may be positioned anywhere on the apparatus that provides for measuring the vacuum pressure established by vacuum pump 60. Similarly, pressure regulator 70 may be positioned differently within the apparatus as long as it continues to regulate the vacuum pressure, e.g., it is in fluid connection with the interior of the vessel and can maintain the stable reduced pressure established by vacuum pump 60. In addition, sight glass 34 may be placed anywhere in the wall of vessel 30 to allow the apparatus' operator to view inside vessel 30, and sight glass 62 may be placed anywhere along pipe 64 such that it provides a view of the inside of pipe 64.

In a preferred embodiment, vessel 30 is a 30 gallon metal ASME tank with sight glass 34 on one end of vessel 30 and 20 foot long hose 80 attached to the other end of vessel 30. Filter 66 is at least a 5 micron filter, pressure regulator 70 is set at 10.18 inches Hg, and power source 50 is a gasoline-powered 3 hp motor. Also, the apparatus has muffler 74 to dampen operating noise, and the apparatus is mounted on supports 36 with apertures 38 for conveniently mounting to skids or wheels (not shown) for ease of movement.

The method of the invention provides several advantages over the prior methods of removing sprinkler system heads. The compact construction of the apparatus, mounted on wheels or skids, provides for ease of movement of the apparatus to one location at which the apparatus will be attached. The pressure differential created in the sprinkler system pipes creates a siphon when a sprinkler head is removed for cleaning, repair or replacement. The siphon removes the water from the sprinkler head drop as the head is being removed from the drop, greatly reducing if not eliminating the risk of black water spilling from the pipe and contaminating the area below the sprinkler head. In addition, the method can preferably be operated and carried out by one person per head removal.

The method also prevents drawing of the pipe gaskets from the couplings that join the sprinkler system pipes. Certain manufacturers of the grooved piping systems used for sprinkler systems recommend that the vacuum pressure in pipes not exceed 10 inches Hg pressure, or the gaskets may be drawn out of the pipes. Manufacturers that provide grooved piping systems include, but are not limited to, Victaulic, Central Grooved Pipe Products, Star Pipe Fittings, Gruvlock, and Grinnell.

The preferred method of removing water includes providing an apparatus as discussed herein, connecting the apparatus to the gang drain valve on a sprinkler system, and creating a reduced pressure within the system. The main gang drain valve may reside on the inside or outside of the building which houses the sprinkler system, and a multi-story building may have only one gang drain valve for the entire system, or one gang drain valve for each floor of the building. In this preferred embodiment, once a vacuum pressure is established in the apparatus by turning on power source 50 which provides power to vacuum pump 60, water is removed from the sprinkler system pipe drops by unscrewing the sprinkler head off of each sprinkler drop. Once each sprinkler head is unscrewed, the vacuum pressure established by vacuum pump 60, which creates a pressure differential between the pressure in the sprinkler system and the atmospheric pressure outside the sprinkler system, creates a siphon or vacuum that removes the trapped water from the sprinkler head drop. The trapped water is siphoned from the sprinkler head drop through the sprinkler system pipes, possibly all the way to vessel 30. The filter 66 prevents water from backing up pipe 64 from vessel 30 into vacuum pump 60.

It is recognized that the apparatus may be attached to any point on the sprinkler system where the hose 80 can be connected such that there is an airtight seal between the hose 80 and the connection point on the sprinkler system. The sprinkler system may be breached at any point on a sprinkler head drop such that the inside of the pipe drop is exposed to air at the atmospheric pressure, causing the siphon that transports the trapped water in the sprinkler drop to vessel 30 on the apparatus.

EXAMPLE 1

The method and apparatus were used on a sprinkler system with 183 sprinkler drops. The embodiment of the apparatus used in this example is depicted in FIGS. 1, 2 and 3 and included a thirty gallon ASME vessel 30, mounted on supports 36 with wheels (not shown) attached at apertures 38. The power source 50 was a 3 hp electric engine, operating at 220V and 1725 rpm. The vacuum pump 60 was Gast Model 6066-V103, operating at 1725 rpm, connected to a filter 66. The pressure regulator 70 was set to maintain 10.18 in. Hg of pressure. The hose 80 was attached to the main alarm valve drain on the sprinkler system. The sprinkler system piping had a one (1) inch outer diameter, and each sprinkler drop was about 18 inches in length. During the replacement of all 183 sprinkler heads in the system, the apparatus and method successfully prevented any substantial release or spillage of water from each of the sprinkler drops.

EXAMPLE 2

In another example, the method and apparatus were used on a sprinkler system with 210 sprinkler drops. The embodiment of the apparatus used in this example is depicted in FIGS. 1, 2 and 3, and included a thirty gallon ASME vessel 30, mounted on supports 36 with wheels (not shown) attached at apertures 38. The power source 50 was a 3 hp electric engine, operating at 220V, and 1725 rpm. The vacuum pump 60 was Gast Model 6066-V103, operating at 1725 rpm, connected to a filter 66. The pressure regulator 70 was set to maintain 10.18 in. Hg of pressure. The hose 80 was attached to the main alarm valve drain on the sprinkler system. The sprinkler system piping had a one (1) inch outer diameter, and each sprinkler drop was about 24 inches in length. During the replacement of all 210 sprinkler heads in the system, the apparatus and method successfully prevented any substantial release or spillage of water from each of the sprinkler drops.

EXAMPLE 3

Figure 4:
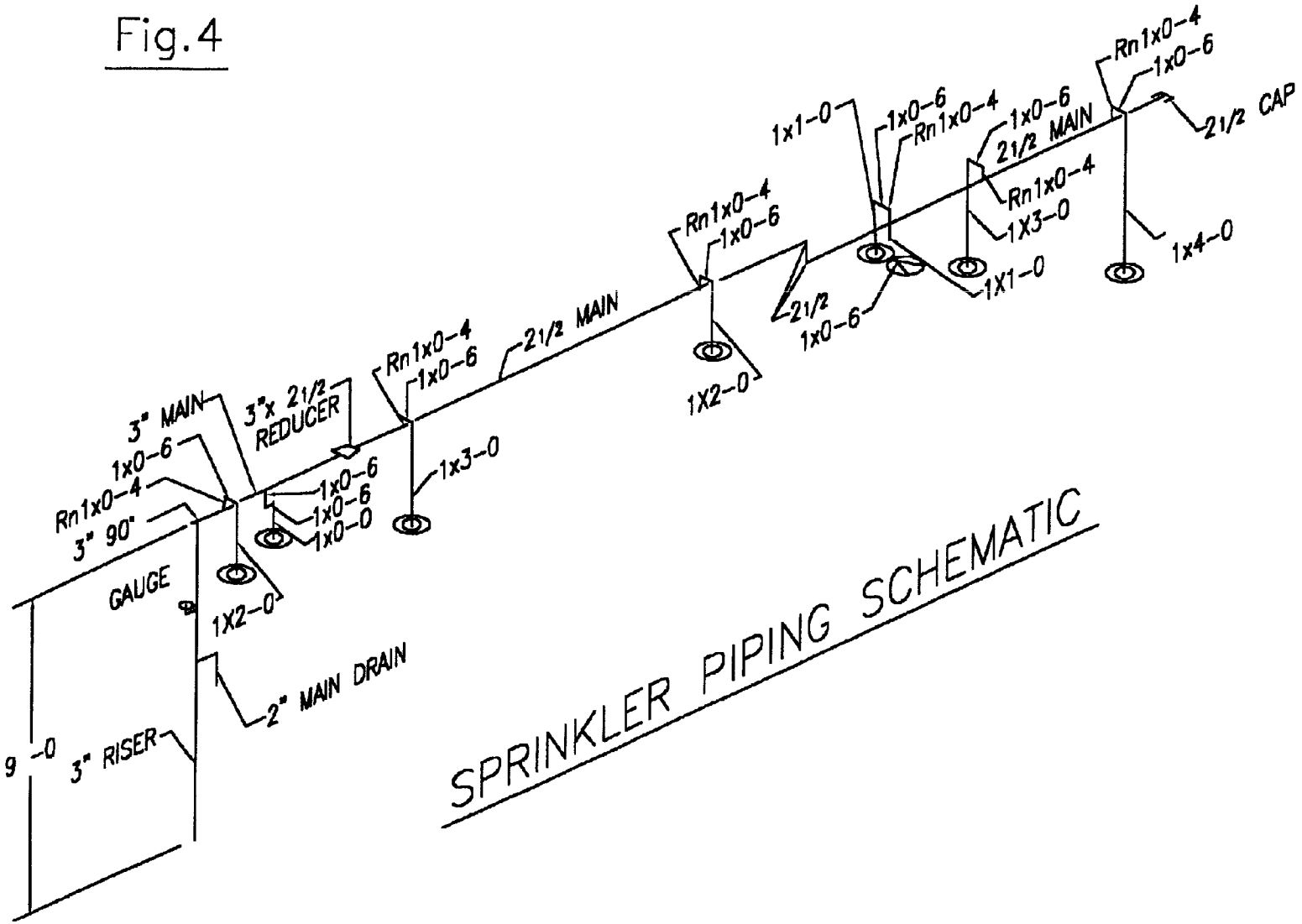
FIG. 4 is a schematic diagram of a mock-up sprinkler system, which was used to test the method and apparatus of the invention.

In another example, the method and apparatus were used on a mock-up of a sprinkler system, as shown on FIG. 4, having 14 feet of 3 inch diameter pipe plus 42 feet of 2 ½ inch diameter pipe with eight drops of various lengths from 1 foot to 4 ½ feet long. The pipes are connected with mechanical couplings: 4-2 ½ inch couplings, 1-3×2 ½ inch reduced couplings, and 3-3 inch couplings. The piping is so arranged that it contains 6 gallons of trapped water, weighing approximately 50 pounds. The embodiment of the apparatus used in this example is depicted in FIG. 1, and included a thirty gallon ASME vessel 30, mounted on supports 36 with wheels (not shown) attached at apertures 38. The power source 50 was a 3 hp electric engine, operating at 220V, and 1725 rpm. The vacuum pump 60 was Gast Model 6066-V103, operating at 1725 rpm, connected to a filter 66. The pressure regulator 70 was set to maintain 10.18 in. Hg of pressure. The hose 80 was attached to the main alarm valve drain on the mock-up sprinkler system. Several sprinkler drops were tested, including the longest sprinkler drop of 4 feet, and no water remained in any of the drops after the test. Also, the removal of two sprinkler heads at the same time did not result in water leakage. The apparatus successfully removed the water from the entire system.

Although the invention has been described and illustrated in detail, it is to be clearly understood that the same is by way of illustration and example only and is not to be taken by way of limitation, the spirit and scope of this invention being limited only by the terms of the appended claims.

What is claimed is:

1. A vacuum apparatus for removing water from a fire safety system, comprising:

a vessel for collecting fluid, said vessel having a fluid inlet aperture, a fluid egress aperture, and an air egress aperture;

a vacuum pump for generating a stable reduced regulated vacuum pressure within said vessel, having a first conduit for withdrawing air from said vessel, said first conduit in fluid connection to said vessel at said air egress aperture, and a second conduit for expelling the air withdrawn from said vessel;

and a connector for fluidly linking the vessel to the fire safety system, said connector having a first and second end, said first end linked to the vessel at the fluid inlet aperture, and said second end having a fitting for linking to the fire safety system.

2. The apparatus of claim 1, further comprising a pressure regulator for maintaining the stable reduced vacuum pressure within said vessel, said regulator being in fluid connection with said vessel such that air is allowed to enter the vessel in order to maintain the stable reduced vacuum pressure.

3. The apparatus of claim 2, wherein said pressure regulator comprises an adjustable pressure valve and at least one gauge for measuring the pressure within the vessel mounted upon said vessel.

4. The apparatus of claim 1, wherein said the stable reduced vacuum pressure up to about 10 inches Hg.

5. The apparatus of claim 1, wherein said vacuum pump maintains said reduced pressure within said vessel within the range of tolerances of the components in the fire safety system.

6. The apparatus of claim 1, wherein said vacuum pump comprises a motor for powering the vacuum pump and a piston assembly.

7. The apparatus of claim 6, wherein said motor has between about 2 to about 6 horsepower.

8. The apparatus of claim 6, wherein said motor is a 3 to 5 horsepower electric, gasoline or diesel motor.

9. The apparatus of claim 1, wherein said fitting is a male to female or female to male reciprocal fitting.

10. The apparatus of claim 1, wherein said fitting is a friction fitting.

11. A method of repairing a sprinkler system having damaged or defective sprinkler heads without water leakage from the sprinkler heads or the joints between the sprinkler heads and pipes of the system, comprising:

providing an apparatus for maintaining a stable reduced regulated vacuum pressure within the system, wherein the apparatus comprises:

a vessel for collecting fluid, said vessel having a fluid inlet aperture, a fluid egress aperture, and an air egress aperture, a vacuum pump for generating a stable reduced regulated vacuum pressure within said vessel, having a first conduit for withdrawing air from said vessel, said first conduit in fluid connection to said vessel at said air egress aperture, and a second conduit for expelling the air withdrawn from said vessel, and a connector for fluidly linking the vessel to the fire safety system, said connector having a first and second end, said first end linked to the vessel at the fluid inlet aperture, and said second end having a fitting for linking to the fire safety system;

placing said apparatus in fluid connection with said sprinkler system;

creating a stable reduced regulated vacuum pressure within said sprinkler system;

and removing said sprinkler heads.

12. The method of claim 11, wherein placing said apparatus in fluid connection with said sprinkler system comprises connecting the second end of the connector of the apparatus to a valve in the sprinkler system.

13. The method of claim 11, wherein said reduced pressure is up to about 10 inches Hg.

14. The method of claim 11, further comprising creating an opening in said pipes such that the inside of said pipes is exposed to the atmosphere.

15. An apparatus for repairing a fire safety system, comprising:

a vessel for collecting fluid, said vessel having at least a first and second aperture in the vessel wall, said first aperture for joining the vessel to the fire safety system, a second aperture for withdrawing the air from the system;

a vacuum pump for generating a stable reduced pressure within said vessel, having a first conduit for withdrawing air from said vessel, said first conduit in fluid connection to said vessel at the second aperture, and a second conduit for expelling air, said second conduit venting to the atmosphere, and a filter for preventing water and debris contamination of the vacuum pump, said filter removeably mounted to said vacuum pump between said vessel and said vacuum pump within the air flow path of the first conduit; and a hose for joining the vessel to the fire safety system, said hose having a first and second end, said first end attached to said first aperture, and said second end having a fitting for linking to the fire safety system.

wherein said vacuum pump maintains said reduced pressure within said vessel at up to about 10 inches Hg.

16. The apparatus of claim 15, wherein said vacuum pump further comprises a power source and a pump operably connected to said power source, said pump fluidly connected to the vessel through the first conduit between the filter and the second conduit.

17. The apparatus of claim 16, wherein said pump is a fan assembly.

18. The apparatus of claim 16, wherein said power source is a motor for powering the pump.

19. The apparatus of claim 16, wherein said power source has between about 3 to about 5 horsepower.

20. The apparatus of claim 15, further comprising a regulator, said regulator being in fluid connection to said vessel such that air is allowed to enter the vessel when the internal pressure is over about 10 psig.

21. The apparatus of claim 20, wherein said regulator includes a spring valve.

22. The apparatus of claim 15, further comprising a third aperture for draining water from the vessel, said aperture located in the wall of the vessel and having a valve for allowing water to escape.

23. The apparatus of claim 15, wherein said fitting is half of a male to female or female to male reciprocal fitting.

24. The apparatus of claim 15, wherein said fitting is a friction fitting.

25. The apparatus of claim 15, wherein the apparatus is mounted on a frame for moving the apparatus.

* * * * *